United States Patent [19]

Soneda et al.

[11] Patent Number: 4,803,480

[45] Date of Patent: Feb. 7, 1989

[54] LIQUID CRYSTAL DISPLAY APPARATUS

[75] Inventors: Mitsuo Soneda; Yoshikazu Hazama, both of Tokyo, Japan

[73] Assignee: Sony Corporation, Tokyo, Japan

[21] Appl. No.: 871,427

[22] PCT Filed: Sep. 12, 1985

[86] PCT No.: PCT/JP85/00508

§ 371 Date: May 12, 1986

§ 102(e) Date: May 12, 1986

[87] PCT Pub. No.: WO86/01926

PCT Pub. Date: Mar. 27, 1986

[30] Foreign Application Priority Data

Sep. 12, 1984 [JP] Japan ..... 59-190783

[51] Int. Cl.[4] ..... G09G 3/36

[52] U.S. Cl. ..... 340/784; 340/718; 340/811; 350/332

[58] Field of Search ..... 340/784, 811, 813, 805, 340/765, 718, 719, 365 C; 350/331 R, 332, 333; 358/241, 230, 236; 361/212; 365/108, 222

[56] References Cited

U.S. PATENT DOCUMENTS

| | | | |
|---|---|---|---|
| 4,319,237 | 3/1982 | Matsuo et al. | 340/784 |
| 4,430,648 | 2/1984 | Togashi et al. | 340/784 |
| 4,485,380 | 11/1984 | Soneda et al. | 340/784 |
| 4,586,039 | 4/1986 | Nonomura et al. | 340/813 |
| 4,600,274 | 7/1986 | Morozumi | 340/784 |

FOREIGN PATENT DOCUMENTS 2069739 8/1981 United Kingdom .

*Primary Examiner*—Gerald L. Brigance
*Assistant Examiner*—Jeffery A. Brier
*Attorney, Agent, or Firm*—Hill, Van Santen, Steadman & Simpson

[57] ABSTRACT

According to the present invention, in a liquid crystal display apparatus, there are provided second horizontal switching elements $M_{Bl}$ to $M_{Bm}$, which are driven at the advanced phase relative to picture element switching signals $\phi_{Hl}$ to $\phi_{Hm}$, at columns $L_l$ to $L_m$ to which a video signal is supplied, a signal, which is derived through said second horizontal switching elements $M_{Bl}$ to $M_{Bm}$, is fed back through an inverting circuit (14) and the like to an input terminal (1), and there are provided third switching elements $M_{Rl}$ to $M_{Rm}$ which are turned on at every predetermined period. According to this apparatus, since a signal derived from a liquid crystal cell C is returned to the same liquid crystal cell C, the displacement of the picture and the like can be avoided, any special scanning and the like are not required and a prior art driving circuit and so on can be used as they are. Further, since the potential of the signal line is reset at every predetermined period, it is possible to prevent the quality of the picture from being deteriorated by a residual charge and the like and the excellent display of a still picture can be carried out over a long time period.

8 Claims, 6 Drawing Sheets

Φ1H

Φ2H

ΦS

φH1
φH2
φH3
φHm-1
φHm

φS'

φH1'
φH2'
φH3'
φHm-1'
φHm'
τ

φH1'
φH2'
φH3'

Pa

Pb

Pc

φa

φb

φc

Pa'

Pb'

Pc'

φa'

φb'

φc'

φH1
φH2
φH3

LIQUID CRYSTAL DISPLAY APPARATUS

TECHNICAL FIELD

The present invention relates to a liquid crystal display apparatus used to carry out the display of a still picture.

BACKGROUND ART

It is proposed to display a television picture by using, for example, a liquid crystal.

In FIG. 6, reference numeral 1 designates an input terminal to which a television video signal is supplied. The signal from this input terminal 1 is supplied through switching elements $M_1$, $M_2$, . . . $M_m$, each of which is formed of, for example, an N-channel FET, to lines $L_1$, $L_2$, . . . $L_m$ in the vertical (Y axis) direction where m is the number corresponding to the number of picture elements in the horizontal (X axis) direction. Further, there is provided a shift register 2 having m stages. This shift register 2 is supplied with clock signals $\Phi_{1H}$, $\Phi_{2H}$ each having a frequency m times the horizontal frequency. Picture element switching signals $\Phi_{H1}$, $\Phi_{H2}$, . . . $\Phi_{Hm}$, which are derived from the respective output terminals of this shift register 2 and sequentially scanned by the clock signals $\Phi_{1H}$, $\Phi_{2H}$ are supplied to the respective control terminals of the switching elements $M_1$ to $M_m$. To the shift register 2, there are supplied a low potential ($V_{SS}$) and a high potential ($V_{DD}$) and thereby drive pulses of the two potentials are generated.

To the respective lines $L_1$ to $L_m$, there are connected one ends of switching elements $M_{11}$, $M_{21}$, . . . $M_{n1}$, $M_{12}$, $M_{22}$, $M_{n2}$, . . . $M_{1m}$, $M_{2m}$, . . . $M_{nm}$, which are each formed of, for example, an N-channel FET, where n is the number corresponding to the number of the horizontal scanning lines. The other ends of these switching elements $M_{11}$ to $M_{nm}$ are respectively connected through liquid crystal cells $C_{11}$, $C_{21}$, . . . $C_{nm}$ to a target terminal 3.

Further, there is provided a shift register 4 having n stages. This shift register 4 is supplied with clock signals $\Phi_{1V}$ and $\Phi_{2V}$ each having a horizontal frequency. Scanning line switching signals $\phi_{V1}$, $\phi_{V2}$, . . . $\phi_{Vn}$, which are derived from the respective output terminals of this shift register 4 and sequentially scanned by the clock signals $\Phi_{1V}$ and $\Phi_{2V}$, are supplied through gate lines $G_1$, $G_2$, . . . $G_n$ in the horizontal (X axis) direction to control terminals of the switching elements $M_{11}$ to $M_{nm}$ at every rows ($M_{11}$ to $M_{1m}$), ($M_{21}$ to $M_{2m}$), . . . ($M_{n1}$ to $M_{nm}$) in the X axis direction, respectively. Also, the shift register 4 is supplied with the potentials $V_{SS}$ and $V_{DD}$ similarly to the shift register 2.

That is, in this circuit, to the shift registers 2 and 4, there are supplied the clock signals $\Phi_{1H}$, $\Phi_{2H}$, $\Phi_{1V}$ and $\phi_{2V}$ which are shown in FIGS. 7A and 7B. Then, the shift register 2 generates signals $\phi_{H1}$ to $\phi_{Hm}$ at every picture element period as shown in FIG. 7C, while the shift register 4 generates signals $\phi_{V1}$ to $\phi_{Vn}$ at every one horizontal period as shown in FIG. 7D. Further, to the input terminal 1, there is supplied a signal as shown in FIG. 7E.

When the signals $\phi_{V1}$ and $\phi$H1 are generated, the switching elements $M_1$ and $M_{11}$ to $M_{1m}$ are turned on and thereby a current path from the input terminal 1 through $M_1$, $L_1$, $M_{11}$, $C_{11}$ to the target terminal 3 is formed, through which a potential difference between the signal supplied to the input terminal 1 and that at the target terminal 3 is supplied to the liquid crystal cell $C_{11}$. As a result, in the capacitive portion of the cell $C_{11}$, there is sampled and then held a charge corresponding to a potential difference made by the signal of a first picture element. The optical transmissivity of the liquid crystal is changed in response to this charge amount. The similar operation is sequentially carried out on the following cells $C_{12}$ to $C_{nm}$ Further, when the signal of the next field is supplied, the charge amounts of the respective cells $C_{11}$ to $C_{nm}$ are re-written.

As described above, the optical transmissivities of the liquid crystal cells $C_{11}$ to $C_{nm}$ are changed in response to the respective picture elements of the video signal, and this operation is sequentially repeated to thereby display a television picture.

By the way, when the display is carried out by the liquid crystal, an AC drive is generally adopted so as to improve its reliability and its service life. In the display of, for example, a television picture, a signal, which results from inverting a video signal at every one field or at every one frame, is supplied to the input terminal 1. In other words, to the input terminal 1, there is supplied a signal which is inverted at every one field or at every one frame as shown in FIG. 7E.

By the way, it is requested to display an arbitrary television picture in the form of a still picture by the above mentioned apparatus. In that case, it has been proposed in the prior art that there is provided a memory having, for example, one field or one frame storage capacity, a desired picture is stored in this memory, it is repeatedly read out therefrom, the signal read out is phase-inverted at every field and then fed to the above mentioned input terminal 1. However, the memory having the capacity of one field or one frame itself is very large in size and expensive so that it is difficult to apply it to a standard commercially available apparatus.

On the other hand, it is proposed to display the still picture by utilizing the memory function of the liquid crystal cell C. That is, in a liquid crystal video display drive circuit having a first sample and hold circuit for supplying a video signal having a polarity inverted at every picture to a plurality of picture elements in a time series fashion, this apparatus is a liquid crystal video display drive circuit which comprises inverting means for inverting the video signal and supplying it to the first sample and hold circuit, a second sample and hold circuit for reading the video signal of the plurality of picture elements in a time series fashion, and switching means for switching a video signal from an external terminal or the video signal from the second sample and hold circuit and supplying it to the inverting means.

However, in the case of this apparatus, each time the display of one field is carried out, the picture is displaced by one picture element each in the scanning direction. As a result, the processing such as to reverse the scanning direction at every one field and the like is carried out. In order to switch the scanning direction as set forth above, a circuit of a large scale must be provided and, there remains the state in which the picture is alternately displaced by one picture element at every one field. It is possible that this will give rise to a flicker and so on.

Since the signal of the liquid crystal cell C is derived, this signal is returned again to the liquid crystal cell C and this operation is repeated to thereby carry out the display of the still picture, if a signal transmission characteristic during such period has a distortion, this distorion is accumulated, deteriorating the quality of the picture considerably in a very short time period. To cope therewith, it may be considered to adjust the gain of the inverting means. However, it is impossible to carry out such adjustment perfectly and it is very difficult to carry out the normal display of the still picture during a long time period.

Further, when the signal is derived from the liquid crystal cell C, if a residual charge exists in a stray capacity of the signal line and the like, this causes the signal to be deteriorated so that the display of the still picture can not be carried out over a long time period.

DISCLOSURE OF INVENTION

This invention is made in view of the above described problems. According to the apparatus, since the signal derived from the liquid crystal cell C is returned to the same liquid crystal cell C, the displacement of the picture and so on can be avoided, any special scanning and the like become unnecessary and the prior art drive circuit and the like can be used without modification. Further, since the potential of the signal line of the signal is reset, the quality of picture can be prevented from being deteriorated and also, it is possible to carry out the display of the still picture over a long time period.

BEST MODE FOR CARRYING OUT THE INVENTION

Figure 1:
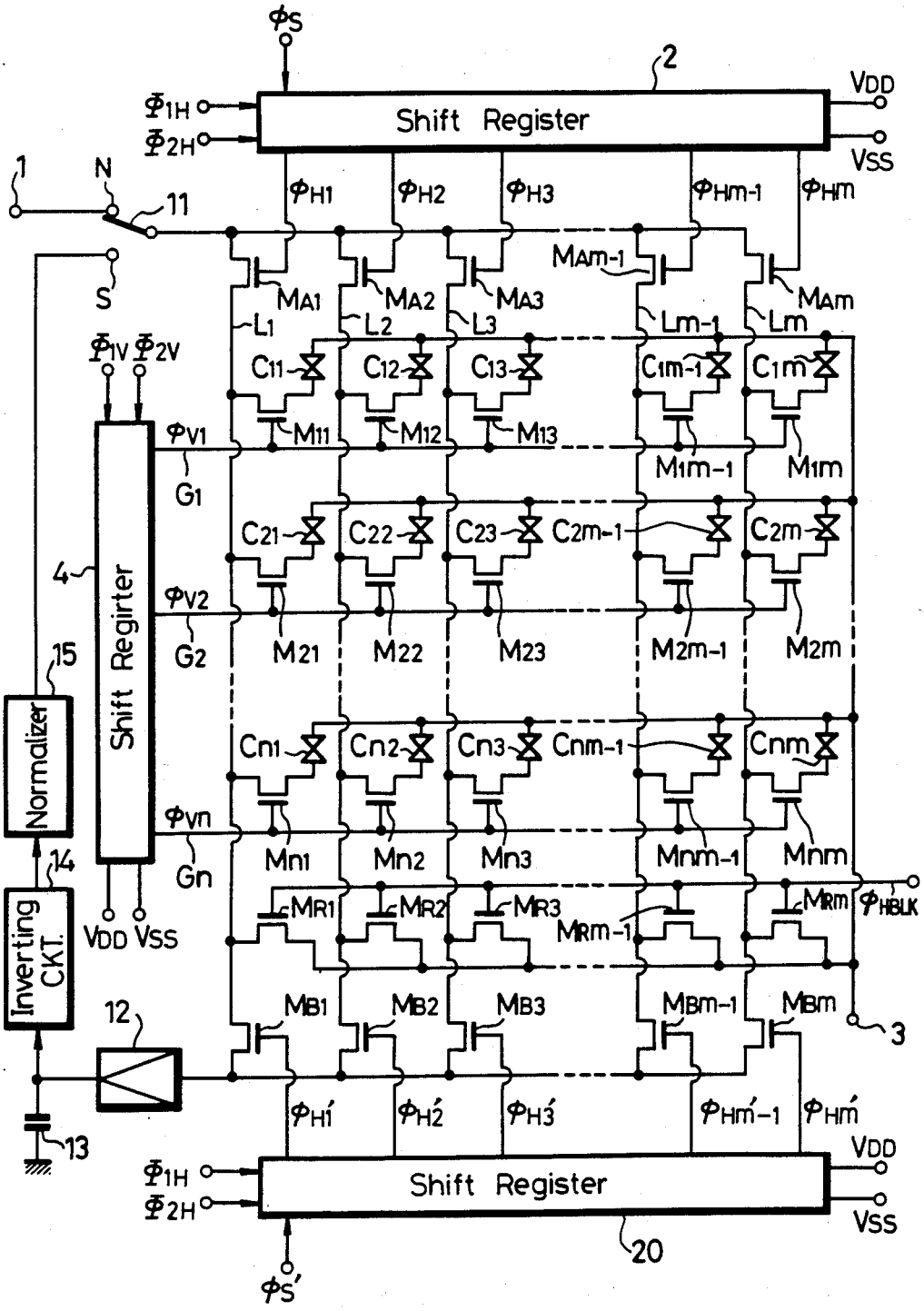
FIG. 1 is an electrical schematic view illustrating the invention.

In FIG. 1, the above mentioned switching elements $M_1$ to $M_m$ are used as first switching elements $M_{Al}$ to $M_{Am}$ and there are provided equivalent second switching elements $M_{B1}$ to $M_{Bm}$. Further, there is provided a shift register 20 having m stages similar to the above mentioned shift register 2. The clock signals $\Phi_{1H}$ and $\Phi_{2H}$ are supplied to this shift register 20. Picture element switching signals $\phi_{H1}$, $\phi_{H2}$, . . . $\phi_{Hm}$ are supplied from the respective output terminals of the shift register 20 to the respective control terminals of the switching elements $M_{B1}$ to $M_{Bm}$. To the shift register 2, there is supplied a start pulse $\phi$s which is associating to the horizontal synchronization of the video signal, while to the shift register 20, there is supplied a start pulse $\phi$'s the phase of which is advanced from that of the pulse $\phi$s. The input terminal 1 is connected through a normal display side contact N of a normal display/still picture display change-over switch 11 to the switching elements $M_{A1}$ to $M_{Am}$. The connecting point among the switching elements $M_{B1}$ to $M_{Bm}$ is connected to an amplifier 12 and a capacitor 13 is connected to the output termina of this amplifier 12. This output terminal is connected through an inverting circuit 14 to a normalizing circuit (normalizer) 15. The output terminal of this normalizing circuit 15 is connected to a still picture display side contact S of the change-over switch 11. To the respective signal lines $L_1$ to $L_m$, there are respectively connected switching elements $M_{R1}$, $M_{R2}$, . . . $M_{Rm}$ and they are connected through these switching elements $M_{R1}$ to $M_{Rm}$ to a predetermined voltage source, for example, a target terminal 3.

Figures 2A, 2B, 2C, 2D, 2E, 2F:
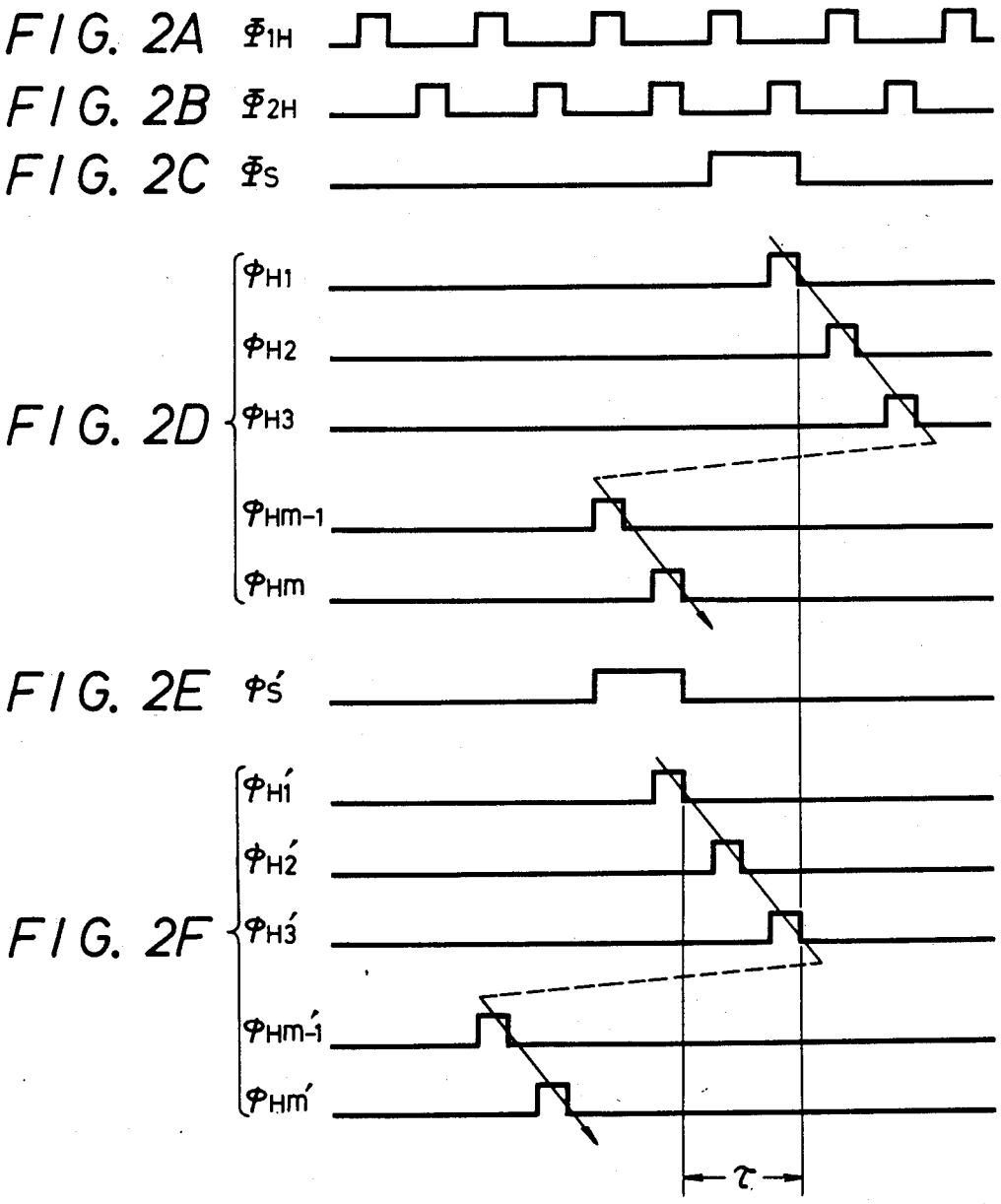
FIG. 2A—2F illustrate waveforms used in the invention.

In this apparatus, to the gate terminals of the switching elements $M_{A1}$ to $M_{Am}$, there are supplied picture element switching signals $\phi_{H1}$ to $\phi_{Hm}$ shown at FIG. 2D and formed by clock signals $\Phi_{1H}$, $\Phi_{2H}$ shown at FIG. 2A and B and the start pulse $\phi$s shown at FIG. 2C. While, to the gate terminals of the switching elements $M_{B1}$ to $M_{Bm}$, there are supplied picture element switching signals $\phi_{H1}'$ to $\phi_{Hm}'$ shown at FIG. 2F and formed by the start pulse $\phi$'s shown, for example, in FIG. 2E.

Consequently, at the phase of, for example, the picture element switching signal $\phi_{H1}$, by the picture element switching signal $\phi_{H3}'$ which is the same in phase, the signal of the liquid crystal cell C corresponding to the line $L_3$ is derived. This signal is accumulated through the amplifier 12 in the capacitor 13 and then written through the inverting circuit 14 and the normalizing circuit 15 in the same liquid crystal cell C at the phase of the picture element switching signal $\phi_{H3}$ with a delay of $\tau$ time. Here, the potential of the signal from the liquid crystal cell C becomes vs and the capacity of the capacitor 13 becomes Cs. Then, a potential vs' at the hot side of the capacitor 13 becomes as $vs' = Cp/Cs\ vs$ where Cp is the capacity of the amplifier 12. If the gain of the inverting circuit 14 is taken as $-A$, a potential vs'' of the output from this inverting circuit 14 becomes as $vs'' = -A\ Cp/Cs\ vs$. Therefore, if the value of $-A$ is determined in such a manner that this potential vs'' satisfies $vs = -vs$, the signal which is the same as that inverted is re-written in the liquid crystal cell C and thereby the still picture display is carried out by the AC drive.

Figure 3:
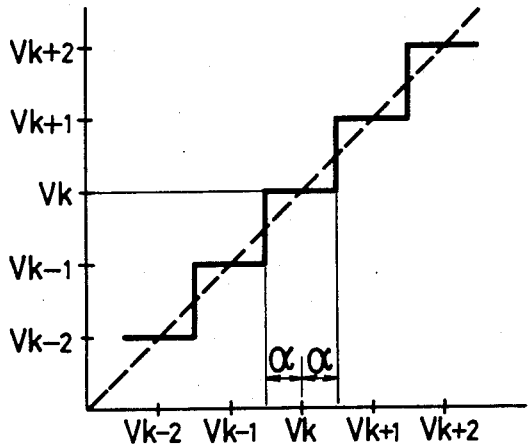
FIG. 3 is a plot illustrating the signal build up.

In this case, however, it is impossible to determine the value of $-A$ perfectly as above mentioned. For this reason, there is provided the normalizing circuit 15. That is, the input and output characteristics of this normalizing circuit 15 is as shown in FIG. 3, in which relative to potentials $Vk-2$, $Vk-1$, $Vk$, $Vk+1$, $Vk+2$, the input signals in a range of $\pm\alpha$ are normalized as $Vk-2$, $Vk-1$, $Vk$, $Vk+1$, $Vk+2$ and are then supplied to the output. Accordingly, owing to the provision of this circuit 15, even if the value of $-A$ has a slight ($\pm\alpha$) error, it is possible to always make the value of the output signal (the re-written signal) constant.

Further, to the gate terminals of the switching elements $M_{R1}$ to $M_{Rm}$, there is supplied a horizontal blanking signal $\phi_{HBLK}$. As a result, the respective signal lines $L_1$ to $L_m$ are reset to the target voltage at every horizontal blanking. Thus, the signal remaining in each signal line is reset so that when the signal in the liquid crystal cell C is derived, a undesired signal can be avoided from being mixed thereto.

In this way, the display of the still picture is carried out. According to the above mentioned apparatus, the arrangement thereof is extremely simplified, and even when the display is carried out over a long time period, the signal can be prevented from deterioration, and hence a satisfactory still picture display can be always be attained.

While in the above mentioned apparatus, the delay time $\tau$ from the readout to the writing is restricted by the periods of the clock signals $\Phi_{1H}$ and $\Phi_{2H}$, it is also possible to set a more delicate delay time by arbitrarily determining the phase of the clock signal which is to be supplied to the shift registers 2 and 20.

Figure 4:
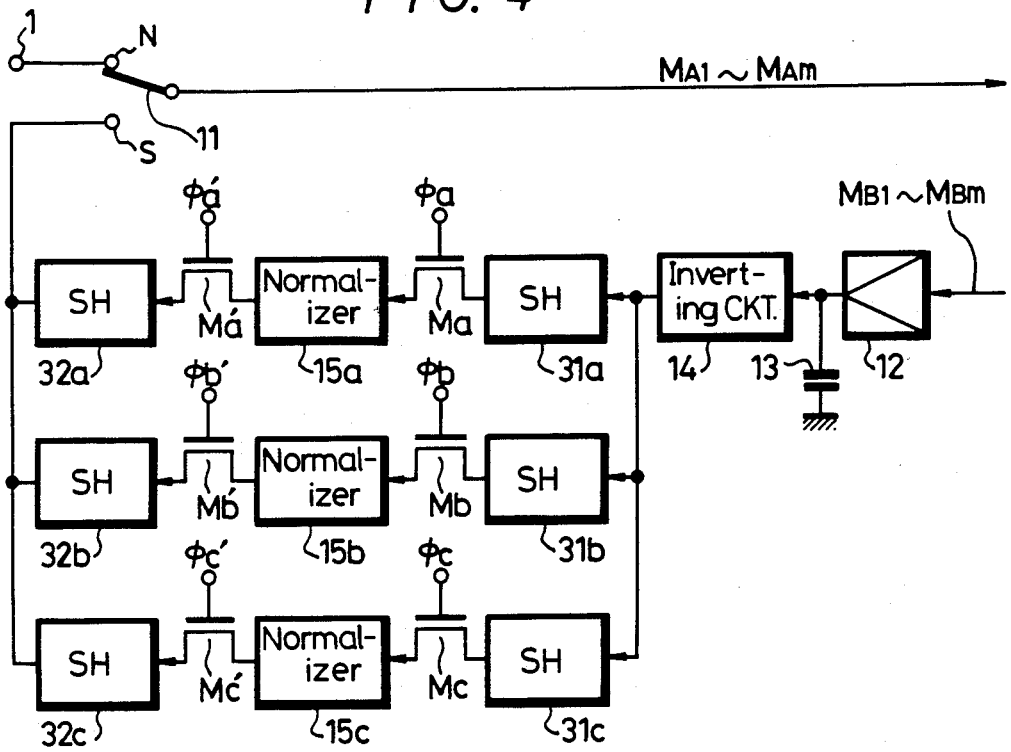
FIG. 4 is a schematic view illustrating a circuit of the invention.

While in the afore-mentioned apparatus the normalizing circuit 15 must carry out sequentially the normalizing processing in a time less than one picture element clock, when the processing time is insufficient in the cases, such as to improve the resolution of the normalization and the like, it is possible to carry out parallel processing as shown, for example, in FIG. 4. In FIG. 4, the display section is omitted. Further, FIG. 5 is a flow chart thereof.

Figures 5A, 5B, 5C, 5D, 5E, 5F, 5G, 5H, 5I, 5J, 5K, 5L, 5M, 5N:
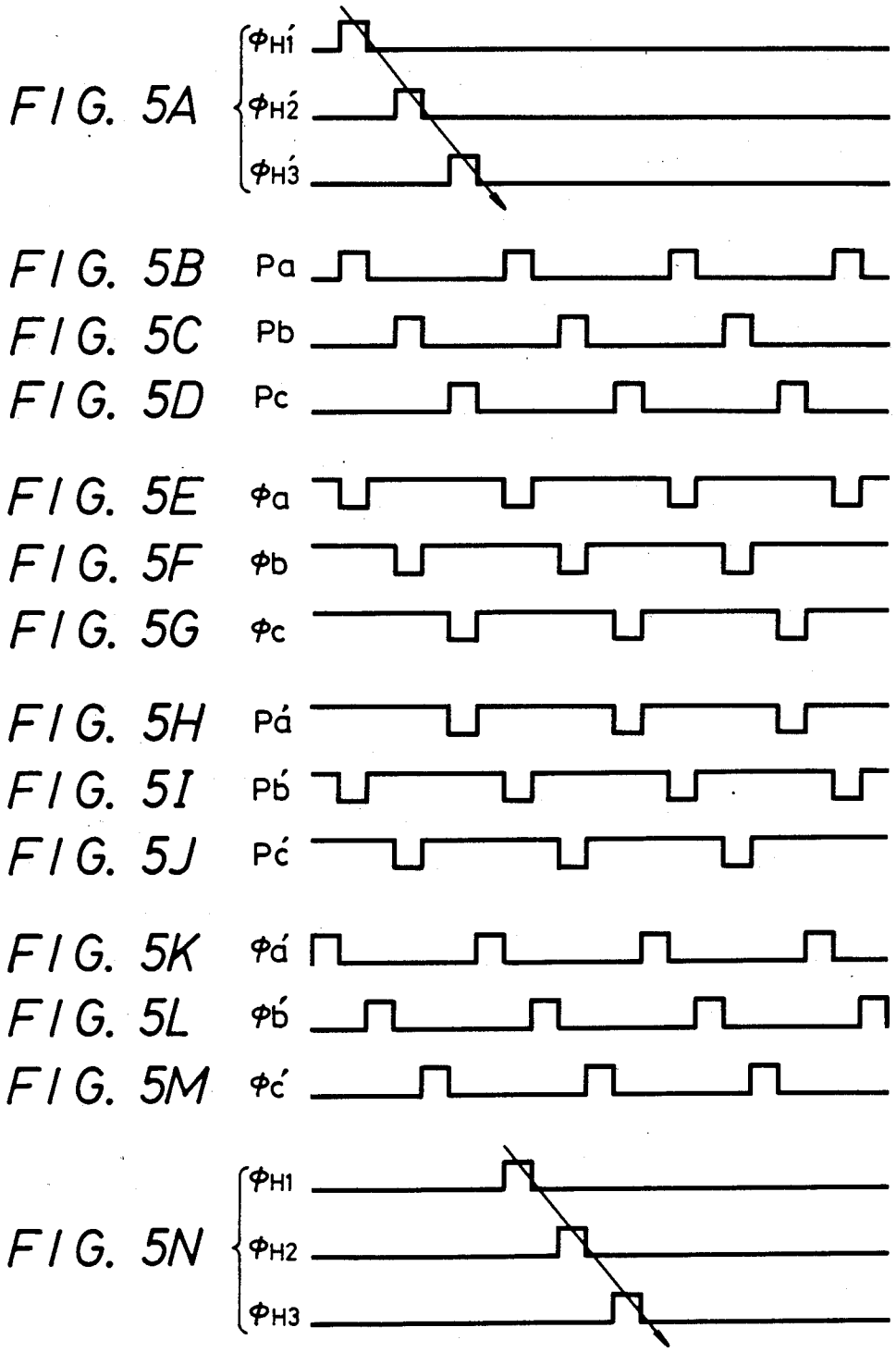
FIG. 5A–5N illustrate waveforms in the invention.
Figure 6:
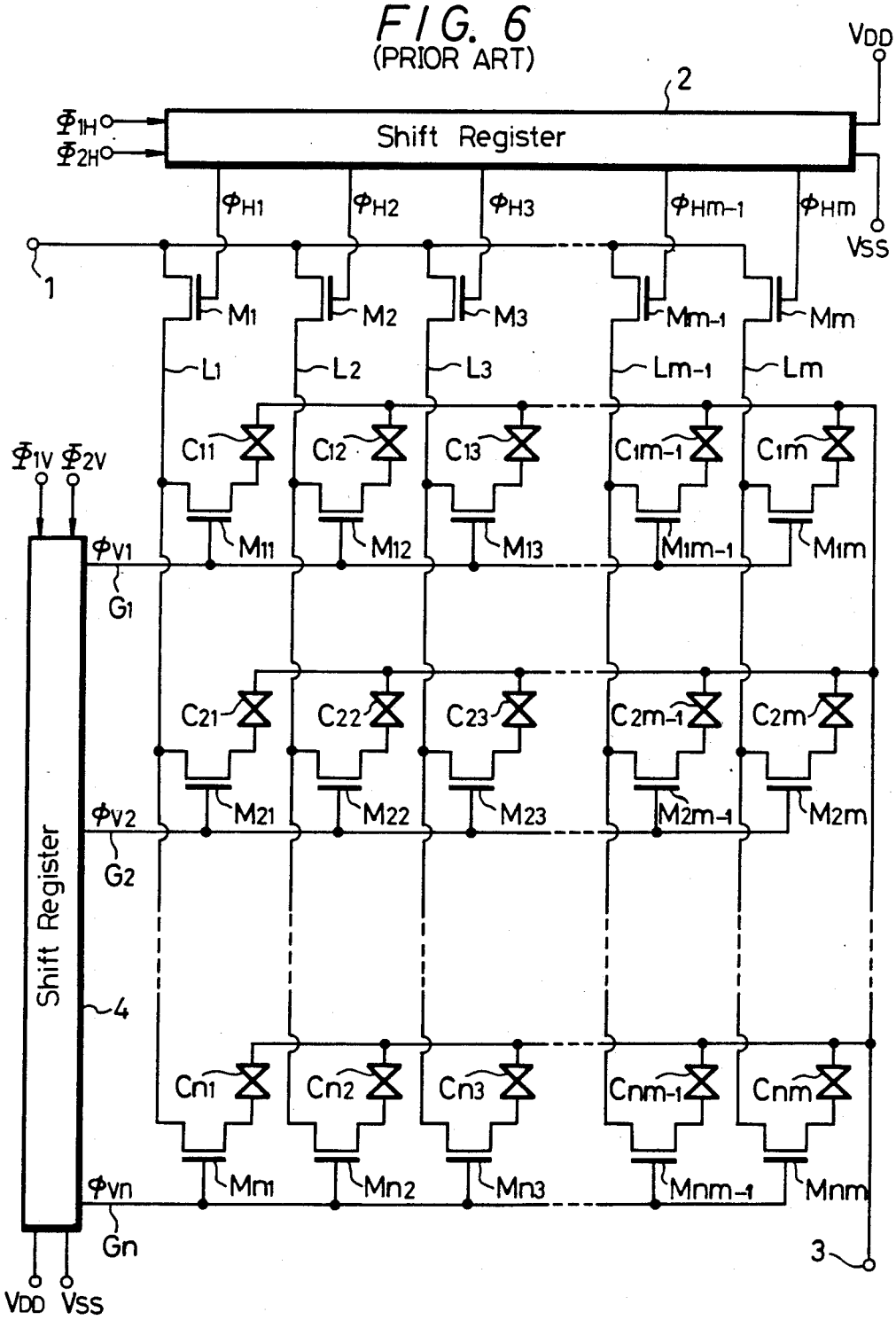
FIG. 6 (PRIOR ART)
FIG. 6 is an electrical schematic of the prior art.
Figure 7A:
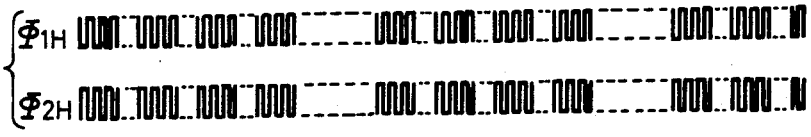
FIG. 7A (PRIOR ART)
FIGS. 7A–7E illustrate waveshapes in the prior art device.
Figure 7B:
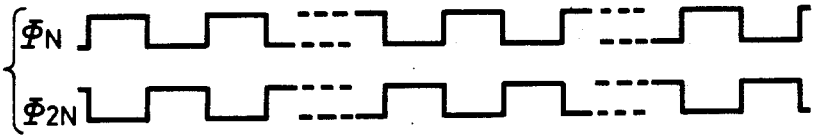
FIG. 7B (PRIOR ART)
Figure 7C:
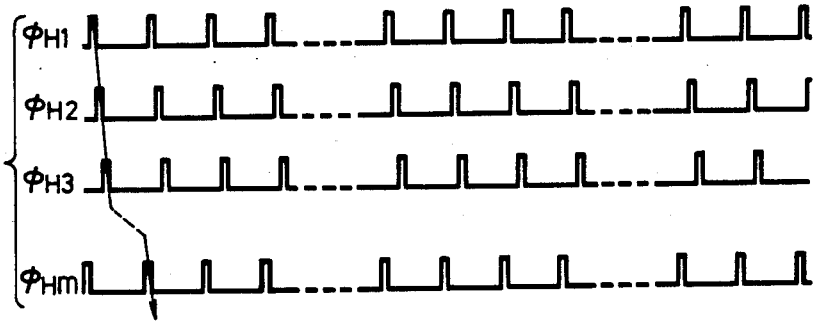
FIG. 7C (PRIOR ART)
Figure 7D:
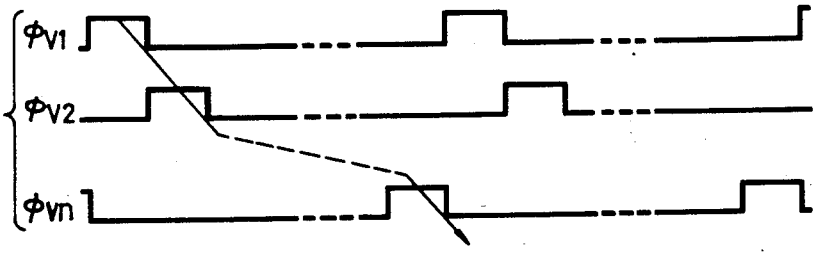
FIG. 7D (PRIOR ART)
Figure 7E:
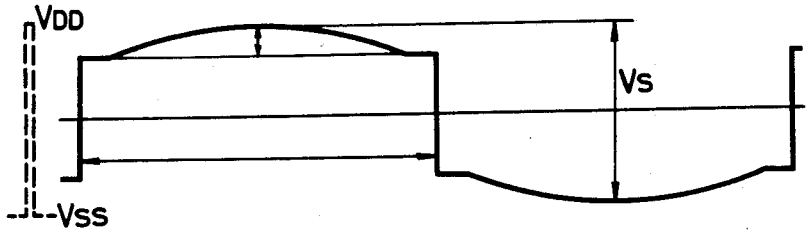
FIG. 7E (PRIOR ART)

That is, in this figure, the signal read out from the liquid crystal cell C connected to the line $L_1$ at the phase of the horizontal switching signal $\phi_{H1}'$ shown, for example, FIG. 5 at A is held in a sample and hold (SH) circuit 31*a* by a sampling pulse Pa shown in FIG. 5 at B and is then supplied through a switching element Ma to a normalizing circuit 15*a* during the period of a switching signal $\phi$a shown in FIG. 5. Then, the signal normalized during the two-picture element clock periods is held during the period of a switching signal $\phi$a' shown in FIG. 5H through a switching element Ma' in a sample and hold circuit 32*a* by a sampling pulse Pa' shown in FIG. 5K and then written in the liquid crystal cell C which is connected to the signal line $L_1$ at the phase of a horizontal switching signal $\phi_{H1}$ shown at FIG. 5N. The similar operations will hereinafter be carried out at every one picture element timing by circuits suffixed by b and c and the operation will be returned to a circuit suffixed by a and thereby repeated at every three picture element clocks. Therefore, according to this apparatus, it becomes possible to set a processing time which is twice that of the apparatus in FIG. 1.

In this case, this apparatus can be applied to a liquid crystal display apparatus formed of an active matrix using TFTs, such as an amorphous silicon, a polysilicon, a silicon sapphire, an organic semiconductor and the like.

Further, it is possible to provide the above mentioned shift registers 2, 4 and 20 outside the IC which forms the apparatus.

Furthermore, the display can be applied to both of dot-sequential type display and line-sequential type display.

We claim:

1. In a liquid crystal display apparatus in which video signals are sequentially supplied to a number of conducting column lines corresponding to the number of effective horizontal picture elements through first horizontal switching elements which are turned on by first picture element switching signals, which are sequentially formed at a horizontal picture element period, scanning line switching signals, which are sequentially formed for different horizontal scanning periods and are sequentially supplied to a number of lines corresponding to the number of effective horizontal scanning lines, and a switch means through which said video signals are sequentially supplied to said column lines in a first switch position, a plurality of picture element switching means mounted at intersections between said column lines and row lines and said picture element switching means turned on by said scanning line switching signals, a plurality of liquid crystal cells each of which forms one picture element, said liquid crystal display apparatus being characterized in that second horizontal switching elements, which are driven when said switch is in a second position by second picture element switching signals which have an advanced phase which is advanced relative to said first picture element switching signals and are connected to said column lines, said video signals stored in said liquid crystal cells are obtained during a period in which said second horizontal switching elements are turned on, said signals so obtained are inverted and said inverted signals have a phase which has been delayed by an amount corresponding to said phase advance are sequentially supplied through said first horizontal switching elements to said column lines to thereby display a still picture when said switch is in said second position, and characterized in that a reset voltage is supplied to each of said columns through third switching elements which are turned on at every horizontal blanking period of said video signal.

2. A liquid crystal display apparatus according to claim 1, characterized in that said inverting processing contains a signal normalization processing.

3. A liquid crystal display apparatus according to claim 2, characterized in that the signal normalization processing contained in said inverting processing is carried out in a parallel processing manner.

4. A liquid crystal display apparatus according to claim 1, characterized in that said first and second picture element switching signals are generated from a pair of shift registers and are used to turn on said first and second horizontal switching elements, respectively.

5. A liquid crystal display apparatus according to claim 4, characterized in that said pair of shift registers are respectively supplied with clock pulses having different phases and a phase difference between said clock pulses becomes a phase difference between said first and second picture element switching signals.

6. A liquid crystal display apparatus according to claim 5, characterized in that said phase difference is made equal to a time period necessary for said inverting processing.

7. A liquid crystal display apparatus according to claim 6, characterized in that said inverting processing contains a signal normalization processing.

8. A liquid crystal display apparatus according to claim 7, characterized in that said signal normalization processing contained in said inverting processing is carried out in a parallel processing manner.

* * * * *